US006575543B2

(12) United States Patent
Ahn

(10) Patent No.: US 6,575,543 B2
(45) Date of Patent: Jun. 10, 2003

(54) APPARATUS FOR ADJUSTING A HEAD GAP OF INK-JET PRINTER

(75) Inventor: Se-woong Ahn, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/153,653

(22) Filed: May 24, 2002

(65) Prior Publication Data

US 2003/0030684 A1 Feb. 13, 2003

(30) Foreign Application Priority Data

Aug. 10, 2001 (KR) ..... 2001-0048363

(51) Int. Cl.[7] ..... B41J 25/308; B41J 29/38
(52) U.S. Cl. ..... 347/8; 347/14
(58) Field of Search ..... 347/8, 14, 23, 347/38, 105, 4, 19, 101, 104, 20; 400/55–56

(56) References Cited

U.S. PATENT DOCUMENTS 6,059,392 A * 5/2000 Park ..... 347/8
6,167,231 A * 12/2000 Blackman et al. ..... 399/364

* cited by examiner

*Primary Examiner*—Raquel Yvette Gordon
*Assistant Examiner*—Charles W. Stewart, Jr.
(74) *Attorney, Agent, or Firm*—Staas & Halsey LLP

(57) ABSTRACT

An apparatus to adjust a head gap of an ink-jet printer. The apparatus includes a shaft rotatably disposed at a main frame and having an eccentric supporting shaft, a head assembly movably disposed on the shaft and having a head to provide ink to a printing medium, a motor to provide a driving force to rotate the shaft, a worm wheel connected to the supporting shaft to rotate in association with the supporting shaft, a rotation angle control unit to restrict a rotation angle of the worm wheel to restrict a range of a head gap between the head and the printing medium, and a clutch unit to selectively transmit the driving force of the motor to the worm wheel and prevent a transmission of the driving force from the motor to the worm wheel when the worm wheel is overloaded by the rotation angle control unit.

12 Claims, 7 Drawing Sheets

APPARATUS FOR ADJUSTING A HEAD GAP OF INK-JET PRINTER

CROSS-REFERENCE TO RELATED APPLICATIONS

This application claims the benefit of Korean Application No. 2001-48363, filed Aug. 10, 2001, in the Korean Industrial Property Office, the disclosure of which is incorporated herein by reference.

BACKGROUND OF THE INVENTION

1. Field of the Invention

The present invention relates to an apparatus to adjust a head gap of an ink-jet printer, and more particularly, to an apparatus to smoothly adjust a head gap of an ink-jet printer.

2. Description of the Related Art

As shown in FIG. 1, a general ink-jet printer has a carriage 3 which moves along a shaft 2 disposed at a main frame 1. The shaft 2 has an eccentric supporting shaft 2*a* to vary a position of the carriage 3 up and down during a rotation thereof. Being supported by a conveying belt 5 rotated by a motor 6, the carriage 3 reciprocates longitudinally along the shaft 2. The carriage 3 includes an ink cartridge 4 and a head 4*a*. The head 4*a* allows ink in the ink cartridge 4 to jet to paper 'P,' which passes underneath the ink cartridge 4, to print a predetermined image on the paper 'P.'

A head gap adjusting means is provided to adjust a gap between the head 4*a* and the paper 'P.' The head gap adjusting means adjusts a position of the shaft 2 to maintain the head gap 'G' according to the thickness of the provided paper 'P.' The head gap adjusting means includes a worm wheel gear 7 connected to the supporting shaft 2*a*, a worm gear 8 drivedly connected to the worm wheel gear 7, and a motor 9 for driving the worm gear 8. The worm wheel gear 7 is connected to the supporting shaft 2*a* and rotates in association with the worm gear 8.

In the state shown in FIG. 2A, the head gap 'G' must be increased when paper 'P' of a greater thickness is supplied. In order to increase the head gap 'G,' the worm gear 8 and the worm wheel gear 7 are rotated in a direction indicated by arrow 'A' by a driving force of the motor 9. Then, the worm wheel gear 7 rotates until a stopper 7*a*, formed on the worm wheel gear 7 is stopped at a protrusion 1*a* formed on a predetermined portion of the main frame 1. Then, the motor 9 is forcedly driven for a predetermined time in the state in which the stopper 7*a* is stopped at the protrusion 1*a*. As a result, the motor is stopped due to a driving load, as shown in FIG. 2B.

On the other hand, in order to reduce the head gap 'G,' the worm wheel gear 7 is rotated in a direction indicated by arrow 'B', as shown in FIG. 2B. The motor 9 is driven until the stopper 7*a* is stopped at another protrusion 1*b,* and then the motor 9 is forcedly stopped due to the driving load. Then, as shown in FIG. 2A, a center of the shaft 2, which is eccentric with respect to the supporting shaft 2*a*, descends such that the head gap 'G' is reduced.

According to the conventional construction as described above, the motor 9 is continuously driven for a predetermined time even after the worm wheel gear 7 is stopped at the protrusions 1*a* and 1*b*. Thus, there is a problem in that gear teeth between the worm gear 8 and the worm wheel gear 7 are dislocated, thereby causing a malfunction. Furthermore, if the worm wheel gear 7 is continuously rotated in a different direction with the dislocated gear teeth, smooth operation is not achieved.

Meanwhile, in another example of a conventional construction, the motor 9 includes an on/off switch, which is controlled to be on/off in accordance with a rotating position of the worm wheel gear 7. Thus, the switch controls the driving of the motor 9. However, there is a problem of an increased cost of installing the on/off switch.

SUMMARY OF THE INVENTION

Accordingly, it is an object of the present invention to solve the above problems.

It is a further object of the present invention to provide an apparatus to smoothly adjust a head gap of an ink-jet printer.

Additional objects and advantages of the invention will be set forth in part in the description which follows and, in part, will be obvious from the description, or may be learned by practice of the invention.

The foregoing and other objects of the present invention are achieved by providing an apparatus to adjust a head gap of an ink-jet printer, including a main frame; a main shaft rotatably disposed at the main frame and having an eccentric supporting shaft; a head assembly movably disposed on the main shaft and having a head to provide ink to a printing medium to print an image thereon; a motor to provide a driving force to rotate the main shaft; a worm wheel connected to the eccentric supporting shaft to rotate in association with the eccentric supporting shaft; a rotation angle control unit to restrict a rotation angle of the worm wheel to restrict a range of the head gap, the head gap being between the head and the printing medium; and a clutch unit to selectively transmit the driving force of the motor to the worm wheel and to prevent a transmission of the driving force from the motor to the worm wheel when the worm wheel is restricted by the rotation angle control unit.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
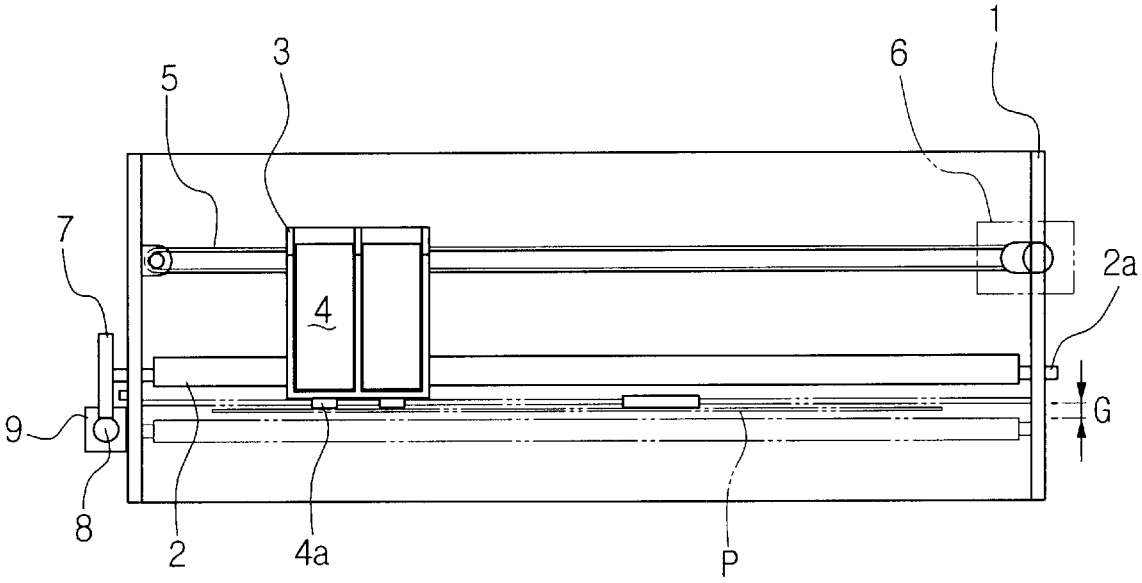
FIG. 1 (PRIOR ART)
FIG. 1 is a schematic view showing a conventional head gap apparatus for an ink-jet printer.
Figure 2A:
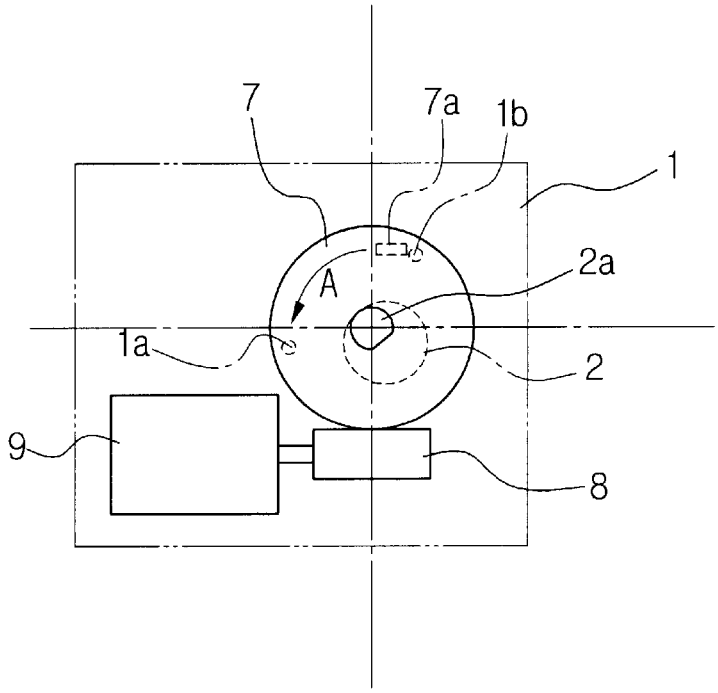
FIG.2A (PRIOR ART)
FIGS. 2A and 2B are views illustrating operations of the conventional head gap apparatus of FIG. 1.
Figure 2B:
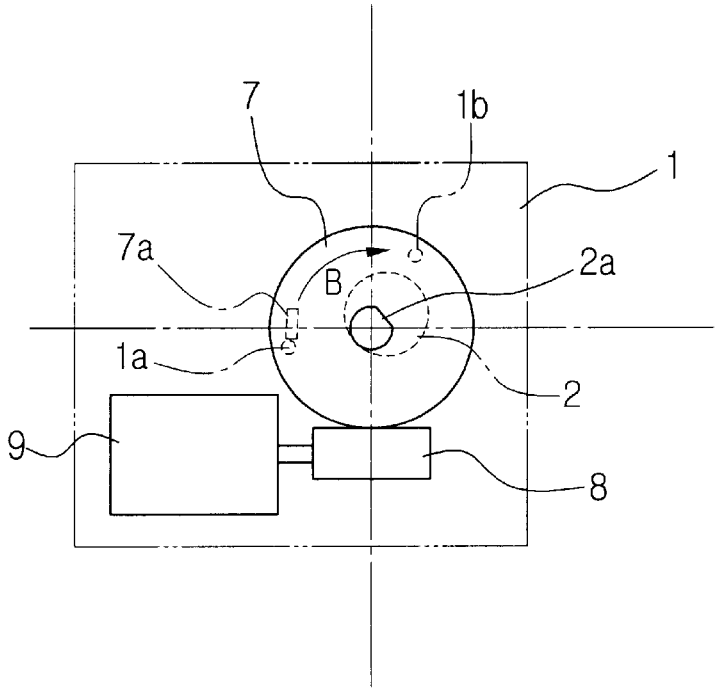
FIG.2B (PRIOR ART)

Reference will now be made in detail to the present preferred embodiments of the present invention, examples of which are illustrated in the accompanying drawings, wherein like reference numerals refer to like elements throughout.

Figure 3:
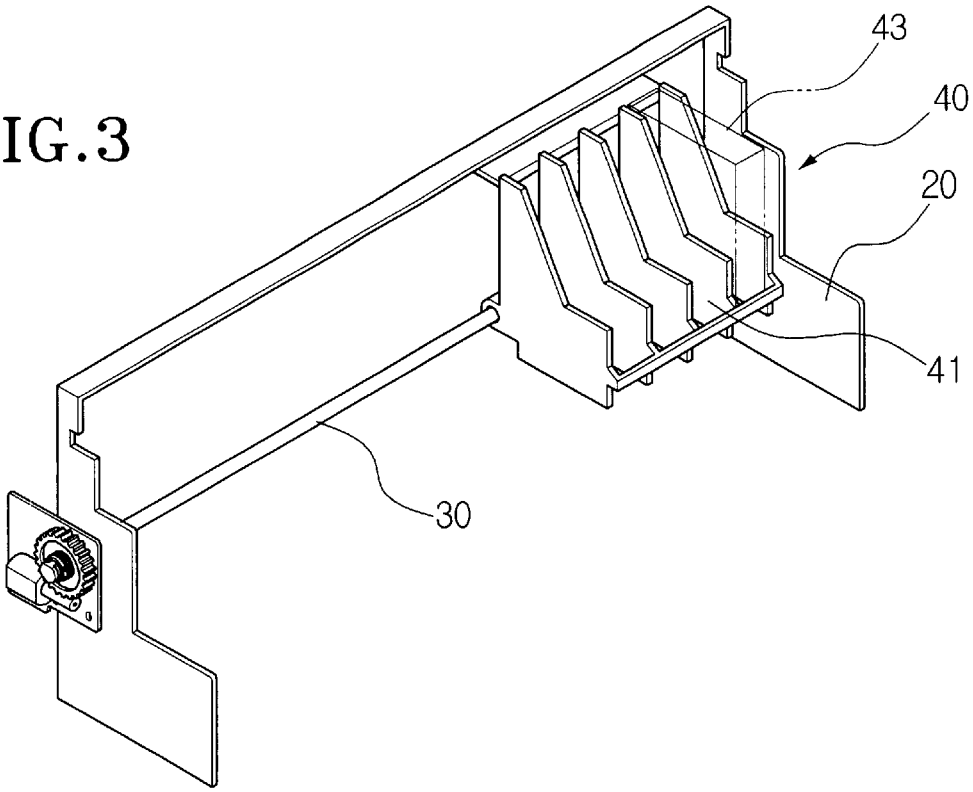
FIG. 3 is a schematic perspective view showing an apparatus to adjust a head gap of an ink-jet printer in accordance with an embodiment of the present invention.
Figure 4:
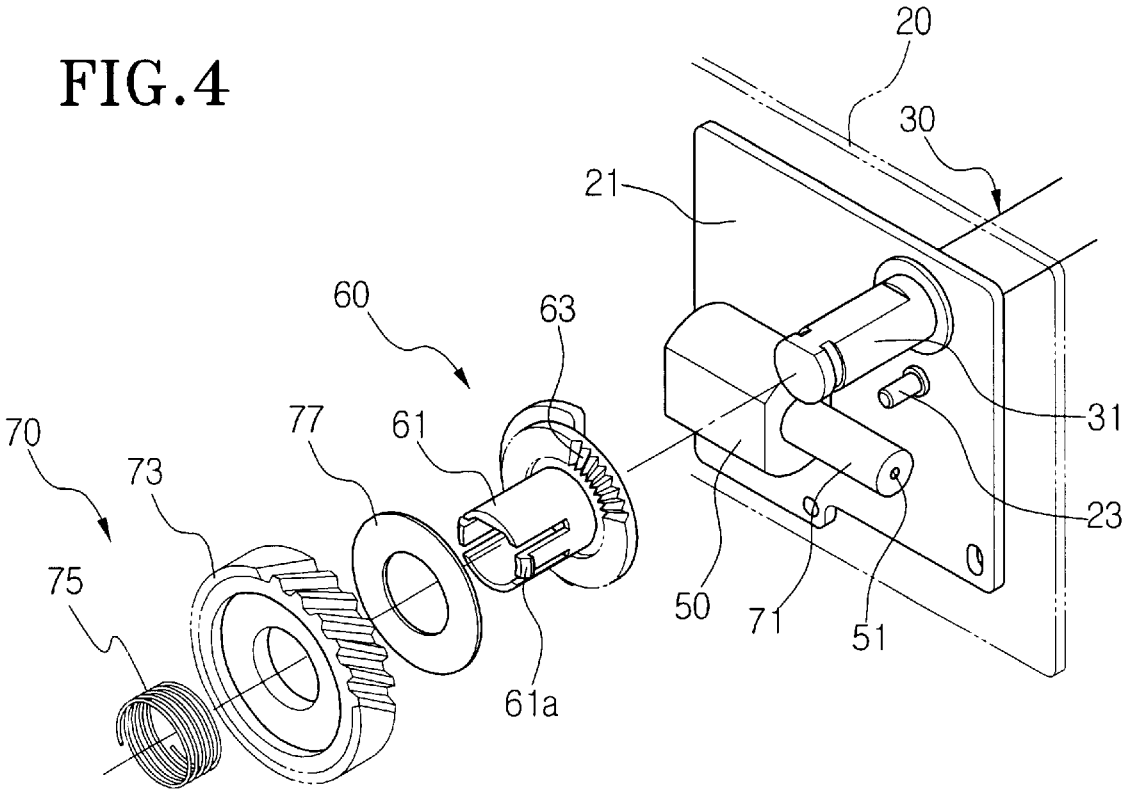
FIGS. 4 and 5 are exploded views showing a portion of the apparatus of FIG. 3.

As shown in FIGS. 3 and 4, an apparatus to adjust a head gap of an ink-jet printer according to an embodiment of the present invention includes a main frame 20 of a printer, a shaft 30 rotatably disposed at the main frame 20, a head assembly 40 movably disposed on the shaft 30, a motor 50, a worm wheel 60, a rotation angle control unit (described below), and a clutch unit 70.

The shaft 30 has a supporting shaft 31, and supports the head assembly 40. A cross-section of the supporting shaft 31 is non-circular. The head assembly 40 has a carriage 41 reciprocating on the shaft 30 by moving means (not shown) and an ink cartridge 43 mounted in the carriage 41. Provided at a lower portion of the carriage 41 is a head (not shown). The head allows ink to jet to paper via a predetermined path, to print an image on the paper.

The motor 50 provides a driving force to rotate the shaft 30. The motor 50 is supported by a supporting bracket 21 disposed at the main frame 20. The worm wheel 60 is connected to the supporting shaft 31 and rotates in association with the supporting shaft 31. The worm wheel 60 has a shaft portion 61 protruding from a first side thereof and a first friction surface 63. The shaft portion 61 is connected to a worm wheel gear 73 and a spring 75 which will be described below. A hook 61*a* is provided at an end of the shaft portion 61 to prevent removal of the spring 75 . The shaft portion 61 is incised at predetermined intervals along a circumference thereof to be elastically formable when connected to the spring 75 and the worm wheel gear 73. The first friction surface 63 is shaped in a predetermined pattern, for example, a gear shape. An inner circumference of the shaft portion 61 has a non-circular shape corresponding to the cross sectional shape of the supporting shaft 31.

Figure 5:
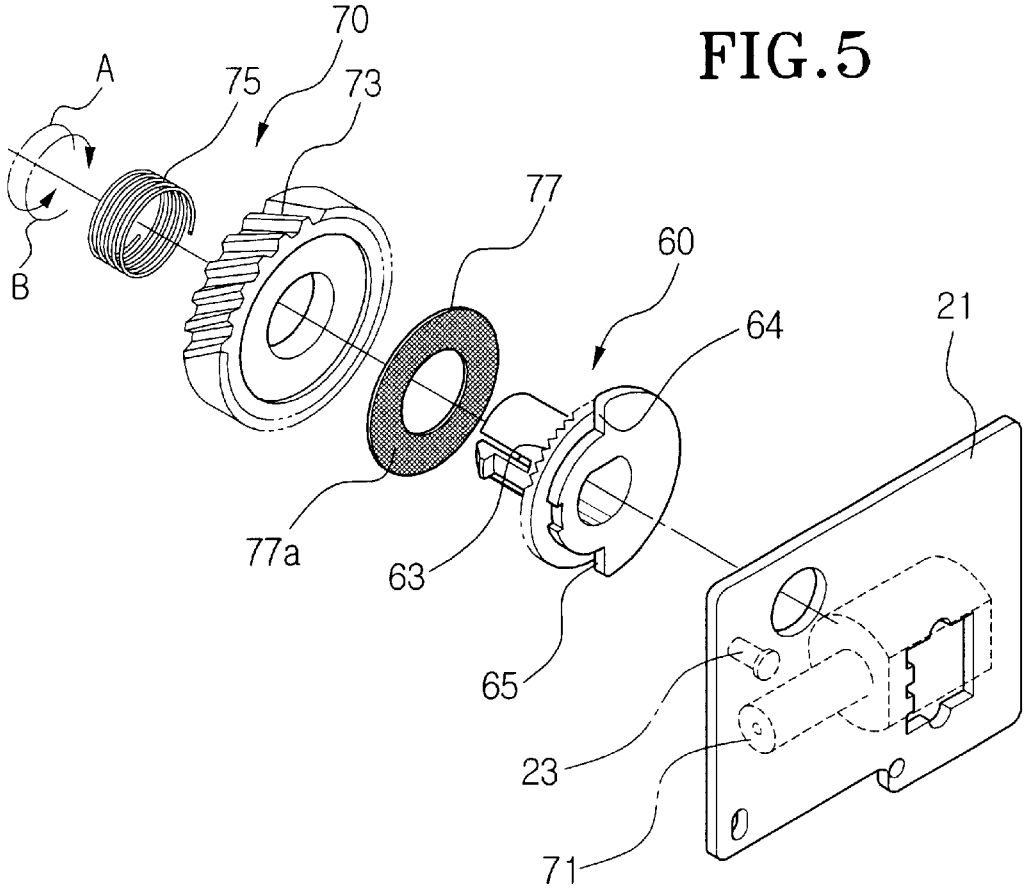

The rotation angle control unit restricts a rotation angle of the worm wheel 60 in order to restrict a range of a head gap between the head of the head assembly 40 and the paper. As shown in FIG. 5, the rotation angle control unit includes a stud pin 23 disposed on the supporting bracket 21 near the supporting shaft 31, and a pair of stoppers 64 and 65 disposed at a second side of the worm wheel 60 to contact the stud pin 23. The stoppers 64 and 65 are formed by cutting a part of the second side of the worm wheel 60 into a step shape within a predetermined portion of a circumference of the worm wheel 60. The stoppers 64 and 65 are respectively in contact with the stud pin 23 when the worm wheel 60 rotates in an 'A' direction or a 'B' direction, thereby preventing the worm wheel 60 from further rotating in the 'A' or 'B' direction. Here, the stoppers 64 and 65 are symmetric to each other with respect to a rotation center of the worm wheel 60.

Figure 6:
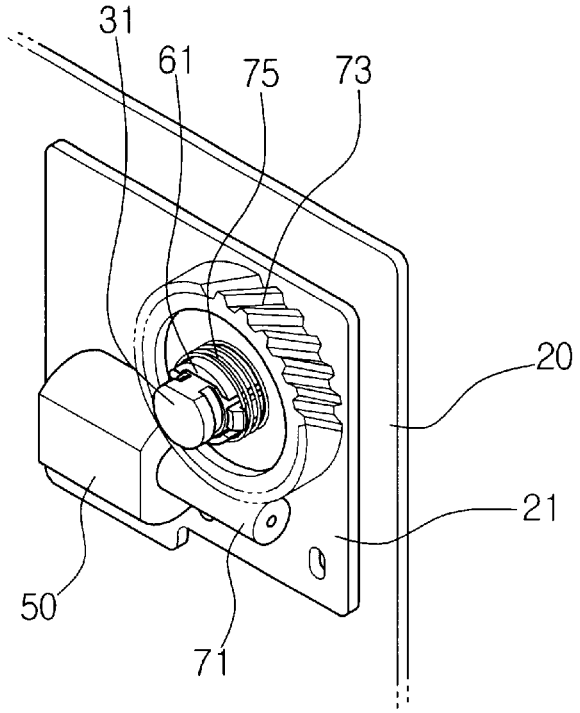
FIG. 6 is a view showing a portion of FIG. 3 in an assembled state.

The clutch unit 70 selectively transmits the driving force of the motor 50 to the worm wheel 60. That is, the clutch unit 70 stops transmitting the driving force to the worm wheel 60 when the worm wheel 60 does not further rotate and is overloaded by the rotation angle control unit. On the other hand, the clutch unit 70 transmits the driving force to the worm wheel 60 when the worm wheel 60 is not overloaded. The clutch unit 70 includes a worm gear 71 combined with a driving shaft 51 of the motor 50, the worm wheel gear 73 engaged with the worm gear 71, and the spring 75. As shown in FIG. 6, a rotation axis of the worm wheel gear 73 crosses that of the worm gear 71 at a right angle such that a rotation direction of the driving force is changed. Also, the worm wheel gear 73 is combined with the shaft portion 61 of the worm wheel 60. The worm wheel gear 73 freely rotates and reciprocates on the shaft portion 61. A friction clutch plate 77 is attached to a surface of the worm wheel gear 73, which faces the worm wheel 60. The friction clutch plate 77 includes a coarse surface, i.e., a second friction surface 77*a*. The friction clutch plate 77 is made of cork material of a thickness of 0.9 mm. Accordingly, when the worm wheel gear 73 moves back or forth, the friction surfaces 77*a* and 63 either contact each other or separate from each other. When the friction surfaces 77*a* and 63 are in contact with each other, the driving force is transmitted. Therefore, the friction surfaces 77*a* and 63 correspond to each other in shape.

The spring 75 is combined with the shaft portion 61 to elastically press the worm wheel gear 73 towards the worm wheel 60. After being combined with the shaft portion 61, the spring 75 is prevented from being removed from the shaft portion 61 by the hook 61*a*. Accordingly, the spring 75 presses the worm wheel gear 73 and thus the worm wheel gear 73 and the worm wheel 60 maintain a combined state thereof, and the driving force can be transmitted. Meanwhile, if the worm wheel 60 is in contact with the stud pin 23 and is overloaded, the respective friction surfaces 77 and 63 overcome a spring force and slidably move with respect to each other due to overload, and the driving force is not transmitted. Accordingly, the motor 50 is prevented from being overloaded.

Operation of the present apparatus as constructed above will now be described.

Figure 7:
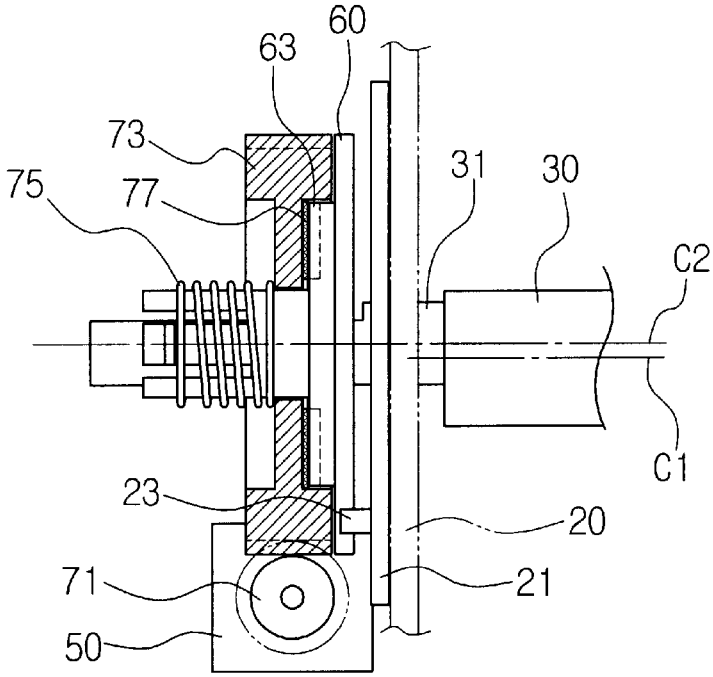
FIGS. 7 through 11 are schematic views illustrating operations of the apparatus in accordance with the embodiment of the present invention of FIG. 3.
Figure 8:
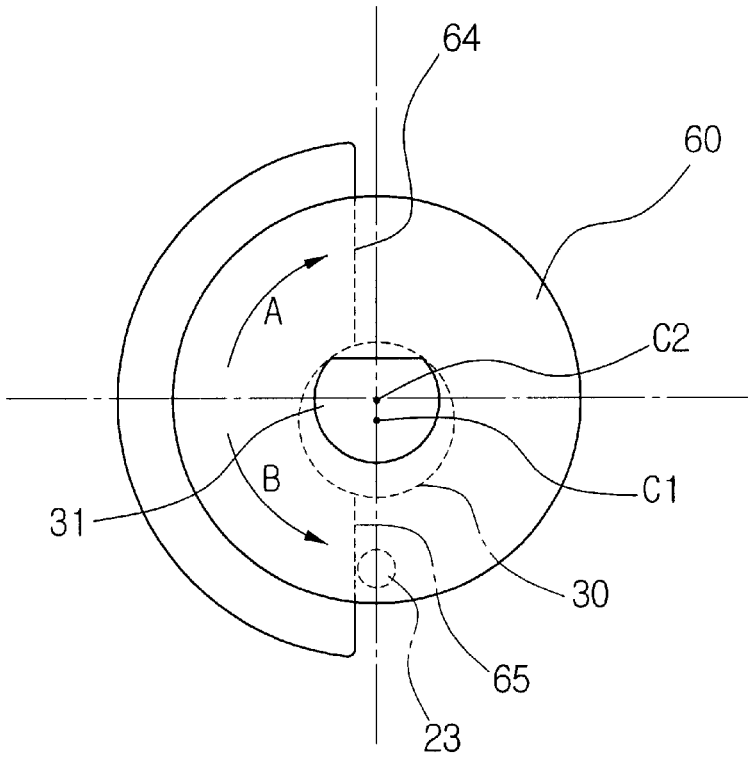
Figure 9:
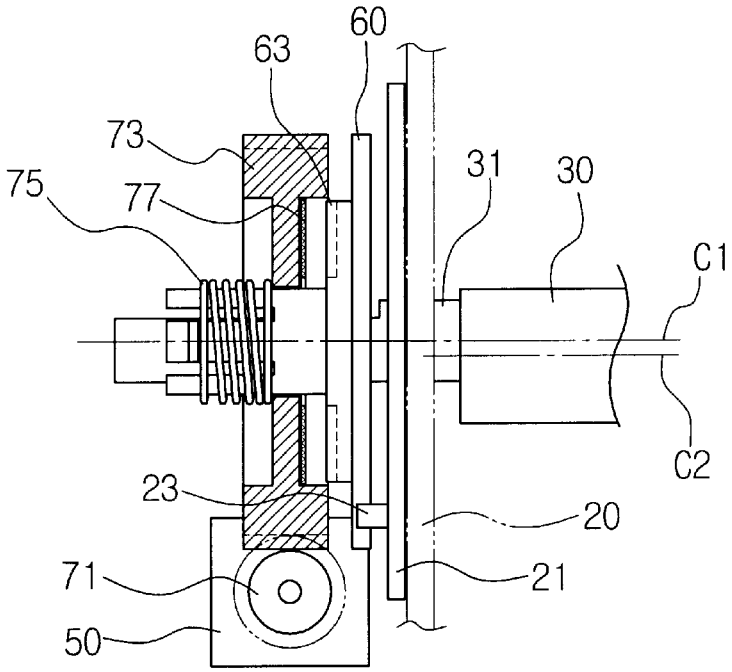

FIGS. 7 and 8 are views showing a state in which the head gap is reduced. As shown in FIGS. 7 and 8, a central axis 'c1' of the shaft 30 is disposed at a lower position than a central axis 'c2' of the eccentric supporting shaft 31. The stopper 65 of the worm wheel 60 does not further rotate in the 'B' direction since the stopper 65 is stopped at the stud pin 23. In this state, if the motor 50 is continuously driven to transmit the driving force in the 'B' direction, the worm wheel gear 73 has a tendency to continuously rotate, whereas the worm wheel 60 does not further rotate by being stopped at the stud pin 23. Accordingly, as shown in FIG. 9, due to the overload affecting the stud pin 23, the worm wheel gear 73 is dislodged outward while compressing the spring 75. The friction surfaces 77*a* and 63 are separated from each other such that a transmission of the driving force therebetween is stopped. As a result, there is an idle rotation of the worm wheel gear 73 and thus the motor 50 is not overloaded. Also, gear teeth between the worm gear 71 and the worm wheel gear 73 are prevented from being misaligned.

Also, if the driving of the motor 50 is stopped after the idle rotation of the worm wheel gear 73, the worm wheel gear 73 is pushed by the spring 75 to the position shown in FIG. 7. Accordingly, the respective friction surfaces 77*a* and 63 are in contact with each other, and free rotation of the worm wheel 60 is prevented due to friction. Therefore, the head gap is maintained.

Figure 10:
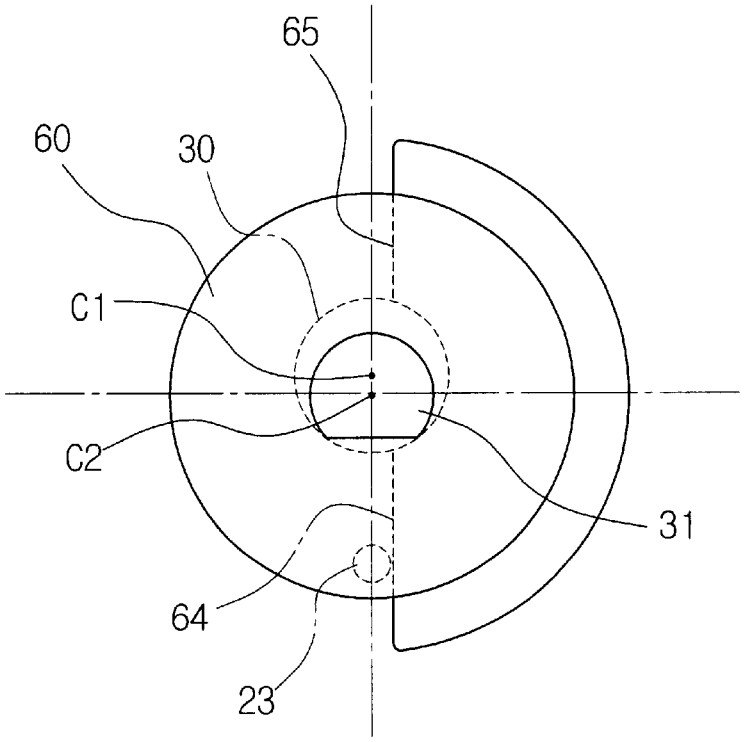

Meanwhile, in order to increase the head gap, the motor 50 is driven to operate the driving force in the 'A' direction in the state of FIG. 8. Then, the worm wheel gear 73 and the worm wheel 60 rotate in association with each other in the 'A' direction due to the friction therebetween. The supporting shaft 31 is also rotated in association with the worm wheel 60. The worm wheel 60, rotating in association with the worm wheel gear 73, does not further rotate when the stopper 64 is in contact with the stud pin 23, as shown in FIG. 10. Thus, the eccentric supporting shaft 31 is stopped. Then, the central axis 'c1' of the shaft 30 is disposed higher than the central axis c2 of the eccentric supporting shaft 31, such that the head gap is maintained.

Figure 11:
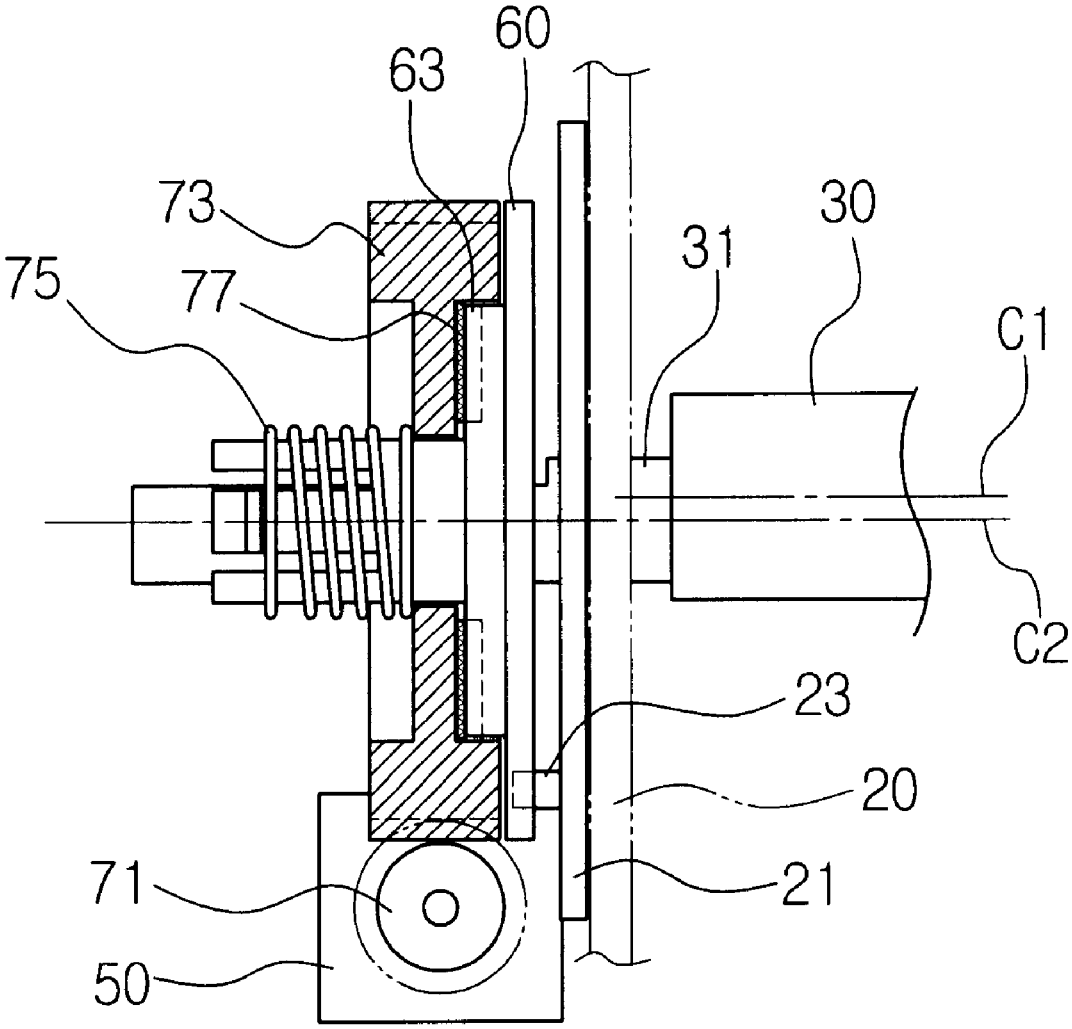

Also, if the motor 50 is continuously driven in the state shown in FIG. 10, since the worm wheel gear 73 rotates with greater power than that of the spring 75, only the worm wheel gear 73 idly rotates and thus presses the spring 75, as described above. In other words, as shown in FIG. 11, the stopper 64 is stopped at the stud pin 23, and the respective friction surfaces 77*a* and 63 are at a separated position from each other. Accordingly, there is no overload to the motor 50. The worm gear 71 and the worm wheel gear 73 operate without stepping out from each other even when rotating in the opposite direction since the gear teeth therebetween are not dislocated.

Since the worm gear 71 and the worm wheel gear 73 can idly operate without requiring the motor 50 to be instantaneously stopped by manipulation of an on/off switch, it is possible to prevent the overload of the motor 50. According to the apparatus to adjust the head gap of the ink-jet printer as described above, the overload of the motor 50 can be prevented by providing the clutch unit 70 to prevent continuous transmission of the driving force from the motor 50 to the worm wheel 60 when the worm wheel 60 is not in operation. Accordingly, the overload of the motor 50 is prevented and the gear teeth between the worm gear 70 and the worm wheel gear 73 are prevented from being dislocated without the need for an on/off switch.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An apparatus to adjust a head gap of an ink-jet printer, comprising:

a main frame;

a main shaft rotatably disposed at the main frame and having an eccentric supporting shaft;

a head assembly movably disposed on the main shaft and having a head to provide ink to a printing medium to print an image thereon;

a motor to provide a driving force to rotate the main shaft;

a worm wheel connected to the eccentric supporting shaft to rotate in association with the eccentric supporting shaft;

a rotation angle control unit to restrict a rotation angle of the worm wheel to restrict a range of the head gap, the head gap being between the head and the printing medium; and a clutch unit to selectively transmit the driving force of the motor to the worm wheel and to prevent a transmission of the driving force from the motor to the worm wheel when the worm wheel is restricted by the rotation angle control unit.

2. The apparatus of claim 1, wherein the rotation angle control unit comprises:

a stud pin disposed on the main frame adjacent to the eccentric supporting shaft; and first and second stoppers disposed at a first side of the worm wheel to stop a rotation of the worm wheel in a forward and reverse direction, respectively, by contacting the stud pin.

3. The apparatus of claim 1, wherein the clutch unit comprises:

a worm gear disposed on a driving shaft of the motor;

a worm wheel gear engaged with the worm gear, to contact and separate from the worm wheel by being moved along an axis of the eccentric supporting shaft towards the worm wheel, the worm wheel gear having a first friction surface disposed thereon to transmit the driving force to the worm wheel when in contact with the worm wheel; and a spring to press the worm wheel gear towards the worm wheel.

4. The apparatus of claim 3, wherein the worm wheel comprises:

a protrusion shaft on a central portion of the worm wheel, the protrusion shaft to support the spring; and a hook at an end of the protrusion shaft, to prevent the spring from being removed from the worm wheel.

5. The apparatus of claim 3, wherein the worm wheel comprises a second friction surface corresponding to the first friction surface of the worm wheel gear.

6. The apparatus of claim 3, wherein the worm wheel gear further comprises a friction clutch plate facing the worm wheel and having a coarse surface comprising the first friction surface.

7. An apparatus to adjust a head gap of an ink-jet printer, comprising:

a head assembly, the head gap being formed between the head assembly and a printing medium;

a wheel to rotate and thereby adjust the head gap;

a motor to drive the wheel; and a clutch unit to selectively transmit a driving force of the motor to the wheel.

8. The apparatus of claim 7, further comprising:

a rotation angle control unit to restrict a rotation angle of the wheel, wherein the clutch unit prevents the transmission of the driving force from the motor to the wheel when the wheel is restricted by the rotation angle control unit.

9. The apparatus of claim 8, wherein the apparatus further comprises a shaft to support the wheel.

10. The apparatus of claim 9, wherein the clutch unit comprises:

a first gear, driven by the motor;

a second gear, engaged with the first gear, to contact and separate from the wheel by being moved along an axis of the shaft;

the second gear having a friction surface disposed thereon to transmit the driving force to the wheel when in contact with the wheel; and a spring to press the second gear towards the wheel.

11. An ink-jet printer, comprising:

a head assembly, a head gap being formed between the head assembly and a printing medium;

a wheel to rotate and thereby adjust the head gap;

a motor to drive the wheel; and a clutch unit to selectively transmit a driving force of the motor to the wheel.

12. An apparatus to adjust a head gap of an ink-jet printer, comprising:

a worm gear;

a motor, a driving force of the motor being transferred to the worm gear;

a worm wheel gear to receive the driving force from the worm gear;

a worm wheel to receive the driving force from the worm wheel gear in a state of operation of the worm wheel; and a clutch unit to prevent transmission of the driving force from the worm wheel gear to the worm wheel when the worm wheel is not in operation.

* * * * *